US007739967B2

(12) United States Patent
Briggs, Jr. et al.

(10) Patent No.: US 7,739,967 B2
(45) Date of Patent: Jun. 22, 2010

(54) PULVERIZED SOLID FUEL NOZZLE ASSEMBLY

(75) Inventors: Oliver G. Briggs, Jr., Jefferson, MA (US); Kevin E. Connolly, Manchester, CT (US); Kevin A. Greco, Ellington, CT (US); Philip H. Lafave, New Hartford, CT (US); Galen H. Richards, Torrington, CT (US)

(73) Assignee: ALSTOM Technology Ltd, Baden (CH)

( * ) Notice: Subject to any disclaimer, the term of this patent is extended or adjusted under 35 U.S.C. 154(b) by 853 days.

(21) Appl. No.: 11/279,123

(22) Filed: Apr. 10, 2006

(65) Prior Publication Data

US 2007/0234938 A1 Oct. 11, 2007

(51) Int. Cl.
*F23C 1/12* (2006.01)
*F23D 1/00* (2006.01)

(52) U.S. Cl. ..... 110/261; 110/265

(58) Field of Classification Search ..... 110/263, 110/347, 104 R, 261, 264, 265; 431/8; 239/587.3, 239/587.4

See application file for complete search history.

(56) References Cited

U.S. PATENT DOCUMENTS 4,206,712 A 6/1980 Vatsky
4,350,297 A * 9/1982 Martin ..... 239/587.4
4,356,975 A * 11/1982 Chadshay ..... 239/419.5
4,400,151 A 8/1983 Vatsky
4,634,054 A * 1/1987 Grusha ..... 239/423
5,315,939 A 5/1994 Rini et al.
5,347,937 A 9/1994 Vatsky
5,388,536 A 2/1995 Chung (Continued)

FOREIGN PATENT DOCUMENTS

EP 0 144 504 6/1985

(Continued)

OTHER PUBLICATIONS

PCT International Search Report dated Sep. 25, 2007—(PCT/US2007/063370).

(Continued)

*Primary Examiner*—Kenneth B Rinehart
*Assistant Examiner*—David J Laux
(74) *Attorney, Agent, or Firm*—Lawrence P. Zale

(57) ABSTRACT

A pulverized solid fuel nozzle assembly 34 includes a fuel feed pipe 38 and a nozzle tip 36 pivotally secured relative to the fuel feed pipe 38. The fuel feed pipe 38 includes a generally cylindrical shell 99 having a round outlet end 102 and a bulbous protrusion 106 disposed around a perimeter of the round outlet end 102. The nozzle tip 36 includes an inner shell 40 having a round inlet end 108 arranged in concentric relationship with the round outlet end 102 of the generally cylindrical shell 99. The round inlet end 108 is disposed around the bulbous protrusion 106 for forming a seal between the inner shell 40 and the fuel feed pipe 38. The nozzle tip 36 also includes an outer shell 39 arranged in coaxial relationship with the inner shell 40, and an annular air channel 42 disposed between the inner and outer shells 40, 39. The nozzle tip 36 is pivotable about at least one axis 52, 250 for directing a stream of pulverized solid fuel from the inner shell 40.

26 Claims, 6 Drawing Sheets

U.S. PATENT DOCUMENTS

| | | | | | |
|---|---|---|---|---|---|
| 5,392,720 | A | * | 2/1995 | Briggs et al. | 110/264 |
| 5,408,943 | A | | 4/1995 | Vatsky | |
| 5,435,492 | A | * | 7/1995 | Tenerowicz | 239/587.6 |
| 5,983,809 | A | | 11/1999 | Vatsky | |
| 6,003,793 | A | * | 12/1999 | Mann | 239/587.5 |
| 6,055,913 | A | | 5/2000 | Gerber et al. | |
| 6,089,171 | A | | 7/2000 | Fong et al. | |
| 6,138,588 | A | * | 10/2000 | Chapman et al. | 110/347 |
| 6,145,450 | A | * | 11/2000 | Vatsky | 110/265 |
| 6,148,743 | A | | 11/2000 | Vatsky | |
| 6,192,811 | B1 | | 2/2001 | Vatsky | |
| 6,237,510 | B1 | * | 5/2001 | Tsumura et al. | 110/262 |
| 6,260,491 | B1 | * | 7/2001 | Grusha | 110/261 |
| 6,439,136 | B1 | * | 8/2002 | Mann et al. | 110/263 |
| 6,959,653 | B1 | | 11/2005 | Mann et al. | |
| 6,986,311 | B2 | | 1/2006 | Vatsky et al. | |
| 2004/0139894 | A1 | | 7/2004 | Vatsky et al. | |

FOREIGN PATENT DOCUMENTS

| | | |
|---|---|---|
| EP | 0 869 313 | 10/1998 |
| WO | WO 98/01704 | 1/1998 |

OTHER PUBLICATIONS

Written Opinion of the International Search Authority dated Sep. 25, 2007—(PCT/US2007/063370).

* cited by examiner

PULVERIZED SOLID FUEL NOZZLE ASSEMBLY

BACKGROUND

The present invention relates to pulverized solid fuel delivery systems and, more particularly, to a nozzle assembly for use in a pulverized solid fuel delivery system.

Systems for delivering pulverized solid fuel (e.g. coal) to steam generators typically include a plurality of nozzle assemblies through which pulverized coal is delivered into a combustion chamber of the steam generator. The nozzle assemblies are typically disposed within windboxes, which may be located proximate the corners of the steam generator. Each nozzle assembly includes a nozzle tip, which protrudes into the combustion chamber. Typically, the nozzle tips are arranged to tilt up and down to adjust the location of the flame within the combustion chamber.

FIG. 1 is a partially-exploded, perspective view of a typical solid fuel nozzle assembly 200 disposed in a fuel compartment 208 of a windbox 202. As depicted in FIG. 1, the solid fuel nozzle assembly 200 comprises a nozzle tip 204 and a fuel feed pipe (conduit) 216. The nozzle tip 204 has a double shell configuration, comprising an outer shell 210 and an inner shell 212. The inner shell 212 is coaxially disposed within the outer shell 210 to provide an annular space 214 between the inner and outer shells 212, 210. The inner shell 212 connects to the fuel feed pipe 216 for feeding a stream of pulverized solid fuel entrained in air through the inner shell 212 into the combustion chamber of the steam generator. The annular space 214 is connected to a secondary air conduit 218 for feeding secondary air through the annular space 214 into the combustion chamber. The secondary air is used in combustion and helps to cool the nozzle tip 204.

The cross sectional shape of the outer shell 210 is typically rectangular and mainly corresponds to the internal cross section of an outlet end 220 of the secondary air conduit 218, which also has a rectangular cross-section. Similarly, the cross sectional shape of the inner shell 212 is typically rectangular and mainly corresponds to the external cross section of an outlet end 222 of the fuel feed pipe 216. However, the fuel feed pipe 216 typically has a round inlet end 224, which requires the use of a round-to-square or round-to-rectangular transition section between the inlet and outlet ends 224 and 222 of the fuel feed pipe 216. While this arrangement is suitable for many applications the distribution of the pulverized solid fuel as it flows through this transition section is neither uniform nor concentric. It is believed that this non-uniform solid fuel distribution can affect the performance of the nozzle 200, and may be disadvantageous in certain applications.

BRIEF SUMMARY

The above-described and other drawbacks and deficiencies of the prior art are overcome or alleviated by a pulverized solid fuel nozzle assembly comprising a fuel feed pipe and a nozzle tip pivotally secured relative to the fuel feed pipe. The fuel feed pipe includes a generally cylindrical shell having a round outlet end and a bulbous protrusion disposed around a perimeter of the round outlet end. The nozzle tip includes an inner shell having a round inlet end arranged in concentric relationship with the round outlet end of the generally cylindrical shell. The round inlet end is disposed around the bulbous protrusion for forming a seal between the inner shell and the fuel feed pipe. The nozzle tip also includes an outer shell arranged in coaxial relationship with the inner shell, and an annular air channel disposed between the inner and outer shells. The nozzle tip is pivotable about at least one axis for directing a stream of pulverized solid fuel from the inner shell In various embodiments: the nozzle tip is pivotable about at least two axes to allow for tilting and yawing of the nozzle tip; the nozzle assembly includes a means for adjusting flame shape disposed within the fuel feed pipe; and at least one of the generally cylindrical shell and the inner shell are lined with at least one of: an abrasion resistant metallic material and a ceramic material. The inner shell and the generally cylindrical shell may have any of a convergent throat, a divergent throat, or a constant diameter throat.

BRIEF DESCRIPTION OF THE DRAWINGS

Referring now to the drawings wherein like items are numbered alike in the various Figures.

DETAILED DESCRIPTION

Figure 1:
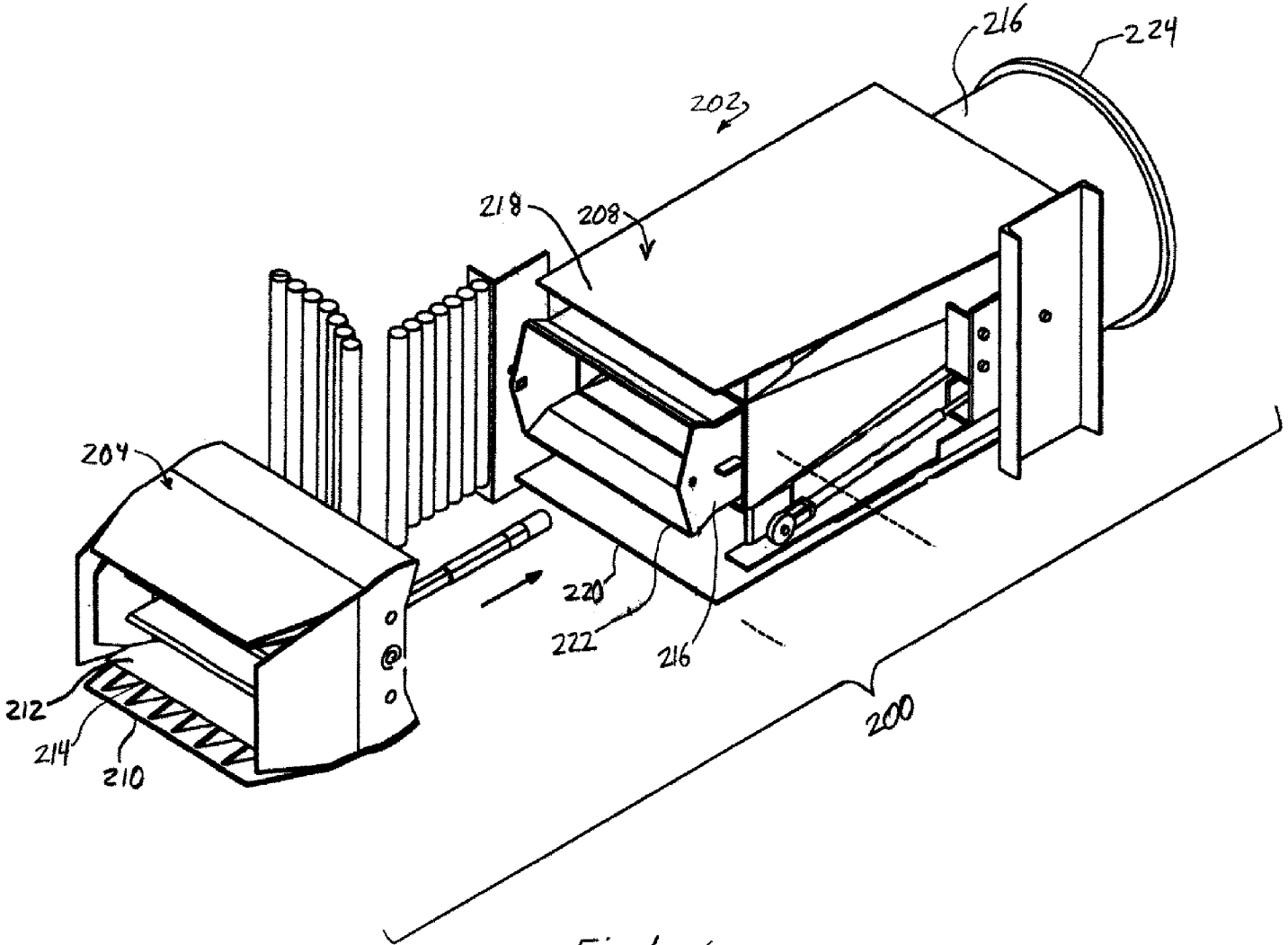
Fig. 1 (Prior Art)
FIG. 1 is a partially exploded perspective view of a pulverized solid fuel nozzle assembly of the prior art.
Figure 2:
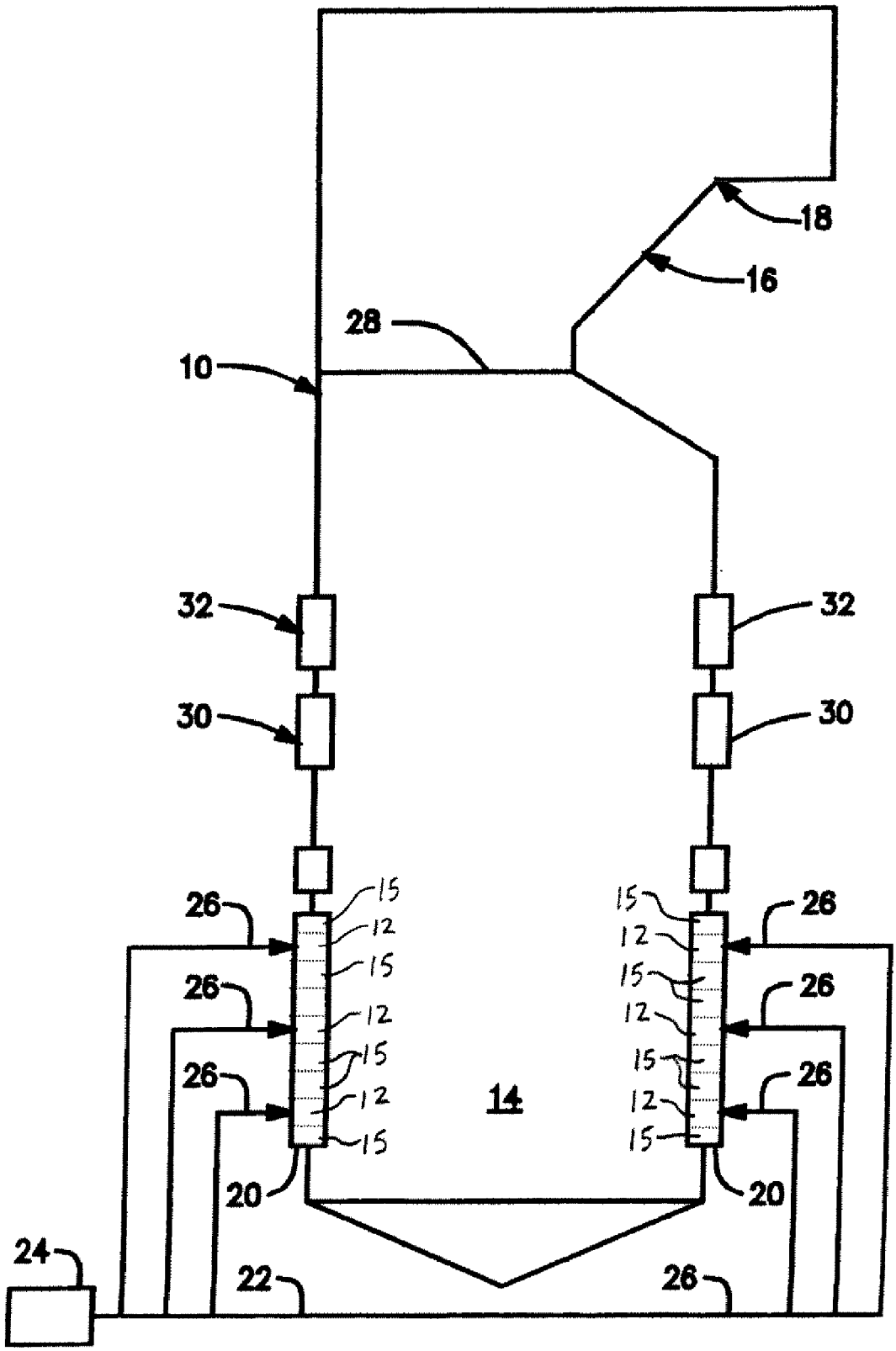
FIG. 2 is a schematic depiction of a solid fuel-fired steam generator including a plurality of windboxes having fuel compartments disposed therein.

Referring now to FIG. 2, a pulverized solid fuel-fired steam generator 10 is shown to include a combustion chamber 14 within which the combustion of pulverized solid fuel (e.g., coal) and air is initiated. Hot gases that are produced from combustion of the pulverized solid fuel and air rise upwardly in the steam generator 10 and give up heat to fluid passing through tubes (not shown) that in conventional fashion line the walls of the steam generator 10. The hot gases exit the steam generator 10 through a horizontal pass 16 of the steam generator 10, which in turn leads to a rear gas pass 18 of the steam generator 10. Both the horizontal pass 16 and the rear gas pass 18 may contain other heat exchanger surfaces (not shown) for generating and superheating steam, in a manner wells known to those skilled in this art. The steam generated in the steam generator 10 may be made to flow to a turbine (not shown), such as used in a turbine/generator set (not shown), or for any other purpose.

The steam generator 10 includes one or more windboxes 20, which may be positioned in the corners of the steam generator 10. Each windbox 20 is provided with a plurality of air compartments 15 through which air supplied from. a suitable source (e.g., a fan) is injected into the combustion chamber 14 of the steam generator 10. Also disposed in each windbox 20 is a plurality of fuel compartments 12, through which pulverized solid fuel is injected into the combustion chamber 14 of the steam generator 10.

The solid fuel is supplied to the fuel compartments 12 by a pulverized solid fuel supply means 22, which includes a pulverizer 24 in fluid communication with the fuel compartments 12 via a plurality of pulverized solid fuel ducts 26. The pulverizer 24 is operatively connected to an air source (e.g., a fan), whereby the air stream generated by the air source transports the pulverized solid fuel from the pulverizer 24, through the pulverized solid fuel ducts 26, through the fuel compartments 12, and into the combustion chamber 14 in a manner which is well known to those skilled in the art.

The steam generator 10 may be provided with two or more discrete levels of separated overfire air incorporated in each corner of the steam generator 10 so as to be located between the top of each windbox 20 and a furnace outlet plane 28 of the steam generator 10, thereby providing a low level of separated overfire air 30 and a high level of separated overfire air 32.

Figure 3:
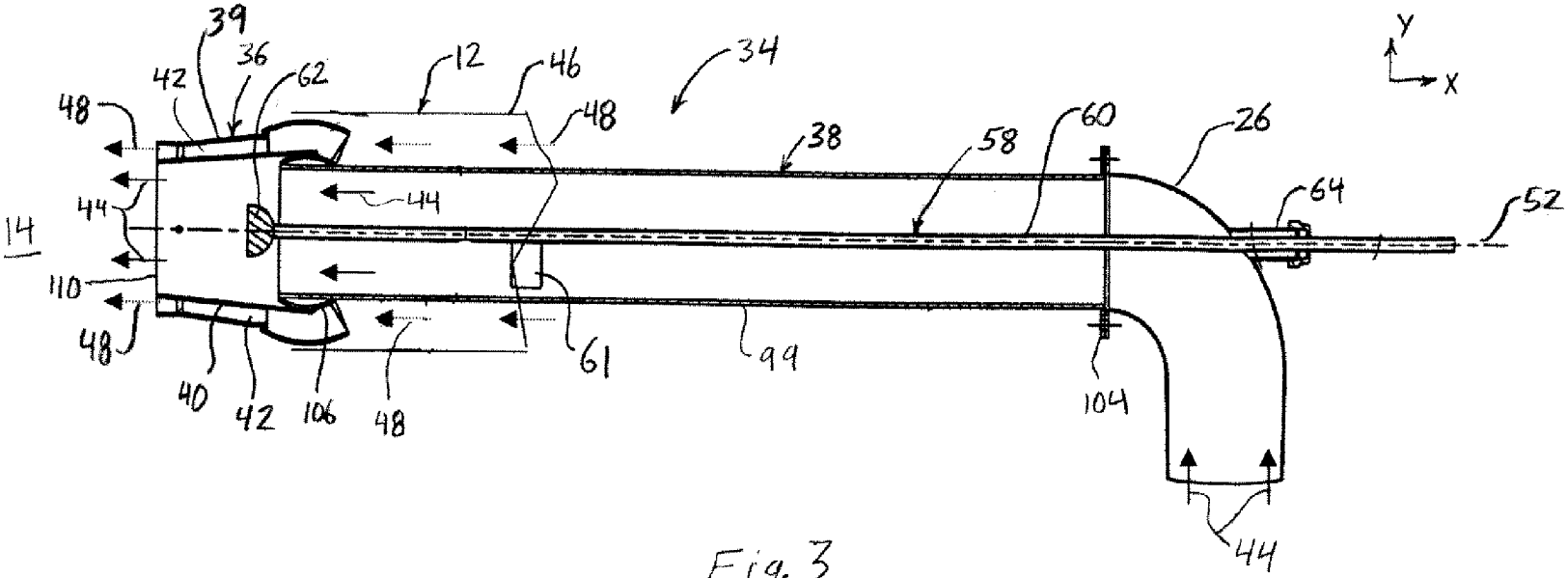
FIG. 3 is a cross-sectional, elevation view of a pulverized solid fuel nozzle assembly disposed within a fuel compartment.
Figure 4:
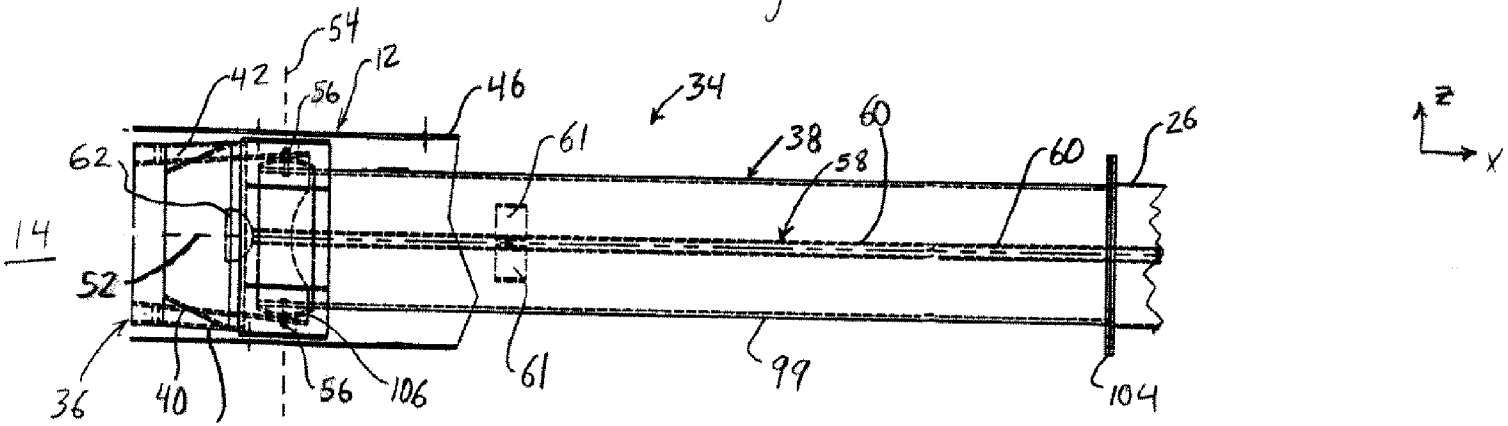
FIG. 4 is a cross-sectional plan view of the pulverized solid fuel nozzle assembly disposed within the fuel compartment.

FIG. 3 depicts a cross-sectional, elevation view of a pulverized solid fuel nozzle assembly 34 disposed within a fuel compartment 12 as taken along an x-y plane, and FIG. 4 depicts a cross-sectional, plan view of the pulverized solid fuel nozzle assembly 34 disposed within the fuel compartment 12 as taken along a x-z plane, which is perpendicular to the x-y plane. While only one fuel compartment 12 is shown, it will be appreciated that each fuel compartment 12 of FIG. 2 may include a nozzle assembly 34. Referring to FIGS. 3 and 4, the nozzle assembly 34 includes a nozzle tip 36, which protrudes into the combustion chamber 14, and a fuel feed pipe 38, which extends through the fuel compartment 12 and is coupled to a pulverized solid fuel duct 26. The fuel feed pipe 38 comprises a generally cylindrical shell 99 having a flange 104 disposed at one end for securing the fuel feed pipe 38 to the solid fuel duct 26 (FIG. 3), and a bulbous protrusion 106 disposed at the other end for providing a seal between the fuel feed pipe 38 and nozzle tip 36, as will be described in further detail hereinafter. By "generally cylindrical" it is meant that the inner surface of the shell provides a flow path having a circular cross-section throughout substantially all of the length of the shell.

The nozzle tip 36 has a double shell configuration, comprising an outer shell 39 and an inner shell 40. The inner shell 40 is coaxially disposed within the outer shell 39 to provide an annular space 42 between the inner and outer shells 40, 39. The inner shell 40 is connected to the fuel feed pipe 38 for feeding a stream 44 of pulverized solid fuel entrained in air through the fuel feed pipe 38 and the inner shell 40 into the combustion chamber 14. The annular space 42 is connected to a secondary air conduit 46 for feeding a stream 48 of secondary air through the secondary air conduit, into the annular space 42, and into the combustion chamber 14. The secondary air is used in combustion and helps to cool the nozzle tip 36.

The nozzle assembly 34 is suitably supported within the fuel compartment 12, and any conventional mounting means may be employed. The secondary air conduit 46 may be coaxially aligned with a longitudinal axis 52 of the generally cylindrical shell 99, such that the fuel feed pipe 38 is centered within the secondary air conduit 46.

It is contemplated that the nozzle assembly 34 may be dimensioned such that the nozzle assembly 34 can be used in place of an existing, prior art nozzle assembly. It will be appreciated that the nozzle assembly 34 can thus be retrofitted into an existing steam generator with minimal modification to existing windbox controls or operation. It is also contemplated that the nozzle assembly 34 can be used in new installations.

The nozzle tip 36 and the fuel feed pipe 38 are coaxially aligned with the longitudinal axis 52. The nozzle tip 36 is pivotally secured relative to the fuel feed pipe 38 such that the nozzle tip 36 is pivotable about an axis 54, which extends perpendicular to the longitudinal axis 52. In the example shown, the nozzle tip 36 is pivotally secured relative to the fuel feed pipe 38 by way of pins 56, which extend from the inner shell 40 to the fuel feed pipe 38 along the axis 54. Alternatively, the nozzle tip 36 may be pivotally secured relative to the fuel feed pipe 38 by way of pins (not shown) extending from the outer shell 39 to the secondary air conduit 46 along the axis 54.

Disposed within the fuel feed pipe 38 is a means 58 for adjusting a flame associated with the nozzle assembly 34. The adjusting means 58 allows for on-line flame shape control and provides the advantage of tailoring the flame front to maximize the reduction in boiler emissions, like NOx and CO. The adjusting means 58 includes a rod 60 extending along the axis 52, and a bluff body 62 (a body having a shape that produces resistance when immersed in a moving fluid) disposed at a free end of the rod 60 and positioned within the nozzle tip 36. The opposite end of the rod 60 extends through a gland seal 64 disposed through the solid fuel duct 26. The gland seal 64 prevents the stream 44 of pulverized solid fuel entrained in air from escaping along the rod 60, while at the same time allowing the rod 60 to move in a direction along axis 52. The rod 60 is supported within the fuel feed pipe 38 by a pair of legs 61, which are fixed to the rod 60 and rest on an inner surface of the fuel feed pipe 38 Movement of the rod 60 and bluff body 62 in a direction along axis 52 allows the shape of the flame to be adjusted.

While FIGS. 3 and 4 depict the use of a bluff body 62, it is contemplated that other structures may be employed by the adjusting means 58. For example, as shown in FIG. 5, a swirler 66 (a body 68 having fins 70 spaced about its perimeter) may be used to impart rotation on the flow of pulverized solid fuel entrained in air.

Figure 5:
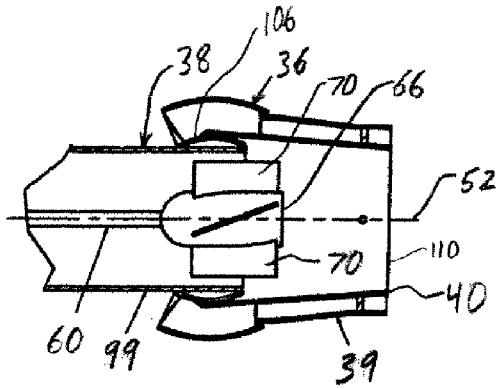
FIG. 5 is a cross-sectional elevation view of a portion of the pulverized solid fuel nozzle assembly including an alternative means for adjusting flame shape.
Figure 6:
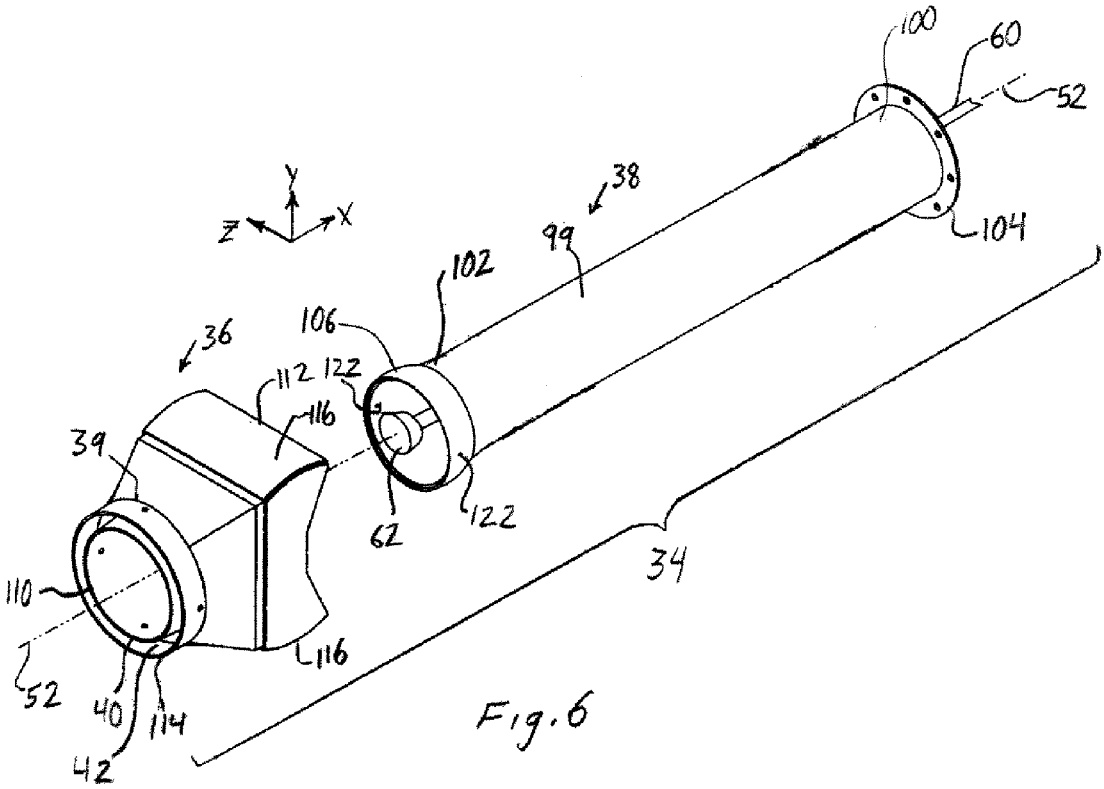
FIG. 6 is a partially exploded, perspective view of the pulverized solid fuel nozzle assembly.

Referring now to FIG. 6, a partially exploded, perspective view of the nozzle assembly 34 is shown. As can be seen in FIG. 6, the generally cylindrical shell 99 has a round inlet end 100 and a round outlet end 102. Disposed around a perimeter of the inlet end 100 is the flange. 104, and disposed around a perimeter of the outlet end 102 is the bulbous protrusion 106. As best seen in FIGS. 3 through 5, the bulbous protrusion 106 has a semi-circular cross-sectional shape, as viewed in any plane in which axis 52 extends. The bulbous protrusion 106 may be formed from a ring attached to the fuel feed pipe 38, or the fuel feed pipe 38 may be shaped, cast, or otherwise formed to include the bulbous protrusion 106.

Figure 7:
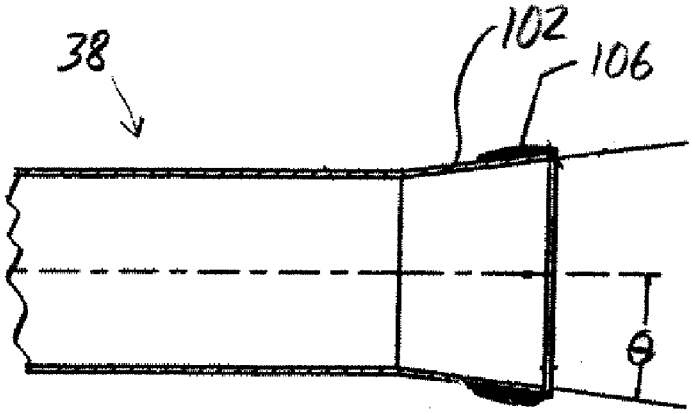
FIG. 7 is a cross-sectional elevation view of a portion of a fuel feed pipe having a divergent throat, as may be used in the pulverized solid fuel nozzle assembly.

In FIGS. 3 through 5, the outlet end 102 of the fuel feed pipe 38 forms a constant diameter throat. That is, the fuel feed pipe 38 has an inside diameter that remains substantially constant throughout the outlet end 102 portion. Alternatively, as shown in FIG. 7, the fuel feed pipe 38 may have a diverging throat. That is, the fuel feed pipe 38 has an inside diameter that increases towards the outlet end 102 ($\theta>0$). It is also contemplated that the fuel feed pipe 38 may have a converging throat, wherein the inside diameter decreases towards the outlet end 102 ($\theta<0$). The shape of the fuel feed pipe 38 may be selected depending on the application of the nozzle assembly 34. For example, it is believed that a constant diameter throat is advantageous for applications where a flame adjusting means 58 is used.

The fuel feed pipe 38 may be constructed of any suitable material, such as, for example, steel, iron, or other metals. Advantageously, the generally cylindrical design of the inner surfaces of the fuel feed pipe 38 allows wear areas of the fuel feed pipe 38 to be fabricated entirely of, or lined with, a wide range of abrasion resistant and/or temperature resistant metallic materials or ceramics. As used herein, an "abrasion resistant metallic material" is any metallic material having a Brinell Hardness greater than or equal to 200 obtained using a 10 mm diameter tungsten-carbide ball indenter with a 3000 kilogram load per ASTM E 10, Standard Test Method for Brinell Hardness of Metallic Materials.

Figure 8:
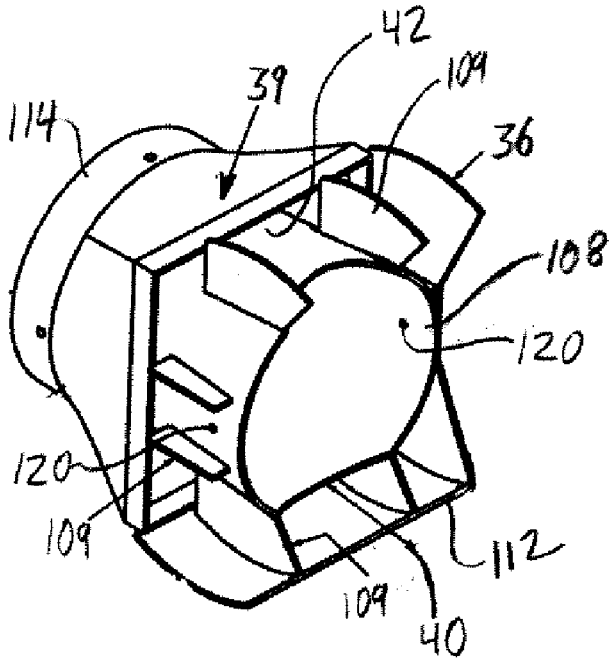
FIG. 8 is a rear perspective view of a nozzle tip, as may be used in the pulverized solid fuel nozzle assembly.

FIG. 8 shows a rear perspective view of the nozzle tip 36, while a front perspective view of the nozzle tip 36 can be seen in FIG. 6. In the view of FIG. 8, a portion of the outer shell 39 has been removed to reveal a plurality of support members 109, which extend from the inner shell 40 to the outer shell 39 for supporting the inner shell 40 within the outer shell 39. As can be seen in FIGS. 6 and 8, the inner shell 40 has a round inlet end 108 and a round outlet end 110.

As best seen in FIGS. 3-5, the inner shell 40 may form a convergent throat wherein the inside diameter of the inner shell 40 decreases towards the outlet end 110. Alternatively, the inner shell 40 may form a constant diameter throat, wherein the inner shell 40 has an inside diameter that remains substantially constant throughout its length, or a divergent throat, wherein the inside diameter of the inner shell 40 increases towards the outlet end 110. The shape of the inner shell may be selected depending on the application of the nozzle assembly 34.

Referring again to FIGS. 6 and 8, the outer shell 39 has an inlet end 112 and an outlet end 114. The outer shell 39 includes a bulbous (arcuate) portion 116 disposed on at least two sides of the inlet end 112, which serves to maintain a seal between the outer shell 39 and the fuel compartment 12 as the nozzle is pivoted about the axis 54 (FIG. 4). In the embodiment shown, the inlet end 112 has a multi-sided cross-sectional shape (e.g., square, rectangular, etc.), and the outlet end 114 is round. However, it is contemplated that the outer shell 39 may employ any convenient shape depending on the application of the nozzle assembly 34. For example, it is contemplated that the outer shell 39 may have multi-sided (e.g., square, rectangular, etc.) inlet and/or outlet ends 112, 114 or round inlet and/or outlet ends 112, 114.

The nozzle tip 36 may be constructed of any suitable material, such as, for example, steel, iron, or other metals, Advantageously, the generally cylindrical design of the inner shell 40 allows wear areas of the inner shell 40 to be fabricated or lined with a wide range of abrasion resistant metallic materials or ceramics.

When the nozzle tip 36 is assembled to the fuel feed pipe 38, the inside surface of the inner shell 40 is disposed around the bulbous protrusion 106 on the outlet end of the fuel feed pipe 38, as shown in FIGS. 3-5. The inside surface of the inner shell 40 and the outer surface of the bulbous protrusion 106 form a seal to substantially maintain separation between the secondary air stream 48 and the stream 44 of pulverized solid fuel entrained in air. To provide this seal, the inside surface of the inner shell 40 is placed in close proximity to the outer surface of the bulbous protrusion 106, with sufficient space between the inside surface of the inner shell 40 and the outer surface of the bulbous protrusion 106 to allow the nozzle tip 36 to pivot relative to the fuel feed pipe 38.

In the embodiment shown, pins 56 (FIG. 4) extend through apertures 120 (FIG. 5) disposed in the inner shell 40 and through apertures 122 (FIG. 6) disposed in the bulbous protrusion 106 to pivotally attach the nozzle tip 36 to the fuel feed pipe 38. This embodiment allows the nozzle tip 36 to pivot relative to the fuel feed pipe 38 about a single axis 54 (FIG. 4), thus allowing the nozzle tip 36 to tilt up and down (when axis 54 is arranged horizontally) or yaw from side to side (when axis 54 is arranged vertically). Alternatively, FIGS. 9 and 10 depict embodiments where the fuel feed pipe 38 is configured to allow for both tilting and yawing of the nozzle tip 36.

Figure 9:
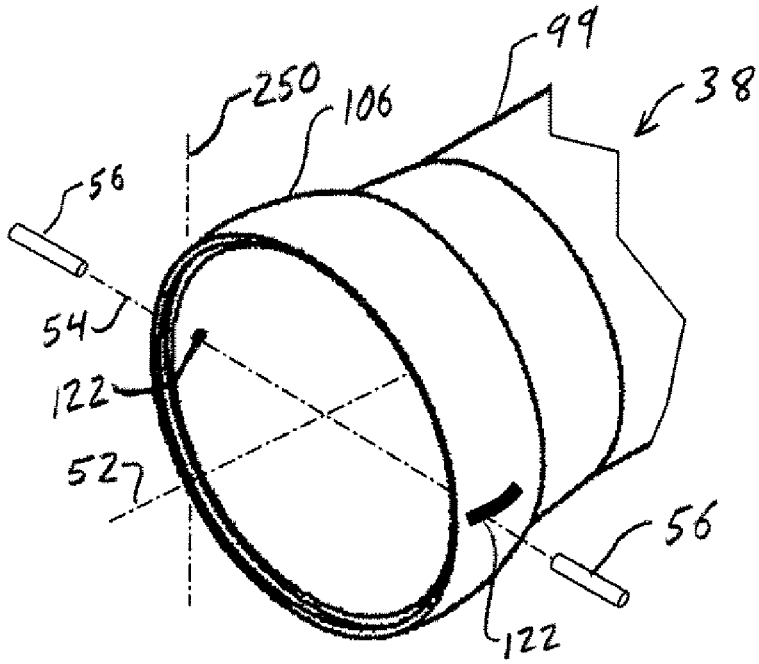
FIG. 9 is a partially exploded, perspective view of a fuel feed pipe configured to allow for tilting and yawing of the nozzle tip.
Figure 10:
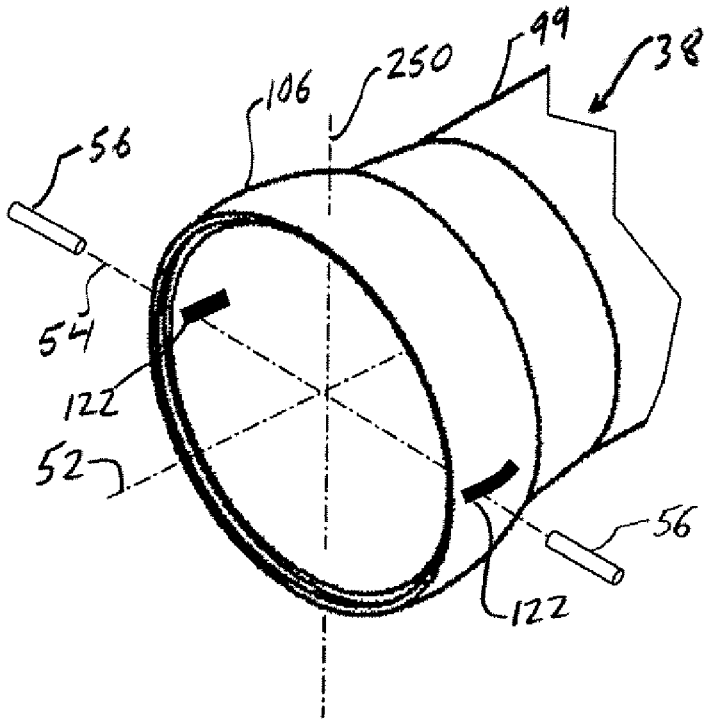
FIG. 10 is a partially exploded, perspective view of an alternative fuel feed pipe configured to allow for tilting and yawing of the nozzle tip.

In the embodiment of FIG. 9, one of the apertures 122 disposed in the bulbous protrusion 106 is elongated, thus allowing the nozzle tip 36 (e.g., FIG. 6) to pivot about an axis 250, which is located at the opposite aperture 122 and extends generally tangential to the outer surface of the bulbous portion 106. Alternatively, as depicted in FIG. 10, both apertures 122 may be elongated, thus allowing the nozzle tip 36 (e.g., FIG. 6) to pivot about an axis 250 extending generally perpendicular to the longitudinal axis 52.

In the various embodiments described herein, the nozzle assembly 34 allows the nozzle tip 36 to pivot relative to the fuel feed pipe 38, thereby directing the stream 44 of pulverized solid fuel as it enters the combustion chamber 14. Such tilting and/or yawing of the nozzle tip 36 allows flame shaping and control, which allows the steam generator to be "tuned" for better operation and emissions control. Advantageously, the nozzle assembly 34 allows such tilting and/or yawing of the nozzle tip 36 while providing a flow path for the pulverized solid fuel that is circular in cross sectional shape. Maintaining a flow path of circular cross section in turn maintains round jet penetration into the furnace, thus providing for uniform radial combustion. This uniformity is believed to provide for better emission control and combustion efficiency. Furthermore, it is believed that maintaining a flow path of circular cross section provides for better airflow through the nozzle tip 36 and subsequent cooling of the nozzle tip 36, which promotes longer life and durability of the nozzle tip 36.

The nozzle assembly 34 also allows for the addition of an adjustable swirler or bluff body for on-line flame shape control. This feature provides the advantage of tailoring the flame front to maximize the reduction in boiler emissions, like NOx and CO. The embodiments described herein may be used in newly designed boilers and windboxes, and are retrofitable into existing steam generators with minimal modification to windbox controls or operation. In addition, the generally cylindrical design allows wear areas of the nozzle tip and/or fuel feed pipe to be fabricated entirely of, or lined with, a wide range of abrasion and/or temperature resistant metallic materials or ceramics.

It should be understood that, unless stated otherwise herein, any of the features, characteristics, alternatives or modifications described regarding a particular embodiment herein may also be applied, used, or incorporated with any other embodiment described herein. Also, the drawings herein are not drawn to scale.

Since the invention is susceptible to various modifications and alternative forms, it should be understood that the invention is not intended to be limited to the particular forms disclosed. Rather, the scope of the invention extends to all modifications, equivalents and alternatives falling within the spirit and scope of the invention as defined by the appended claims.

What is claimed is:

1. A nozzle tip for a pulverized solid fuel nozzle assembly, the nozzle tip comprising:

an inner shell a generally round cross section throughout its length, the inner shell having a round inlet end configured to surround a round outlet end of a fuel feed pipe, the inner shell having at least two shell apertures between the round inlet end and the round outlet end, wherein at least a portion of one of the shell apertures is generally diametrically opposite from the other shell aperture;

an outer shell arranged in coaxial relationship with the inner shell, and an annular air channel disposed between the inner and outer shells;

c. a first pin passing through a shell aperture into outlet end of the fuel feed pipe; and d. a second pin passing through the other shell, aperture and into the outlet end of the fuel feed pipe aperture;

wherein the nozzle tip is pivotable about at least two axes to allow for tilting around the first and second pins and at least one aperture is elongated allowing one of the pins to slide and pivot within it allowing yawing of the nozzle tip and for directing a stream of pulverized solid fuel from the inner shell to a desired location.

2. The nozzle tip of claim 1, further comprising:

a means for adjusting flame shape disposed within the fuel feed pipe.

3. The nozzle tip of claim 1, wherein the outer shell has an inlet end having a multi-sided cross sectional shape and an outlet end having a round cross sectional shape.

4. The nozzle tip of claim 3, wherein the inlet end of the outer shell includes a bulbous portion disposed on at least two sides of the multi-sided cross sectional shape.

5. The nozzle tip of claim 1, wherein the inner shell has a convergent or divergent throat.

6. The nozzle tip of claim 1, wherein the inner shell has a constant diameter throat.

7. The nozzle tip of claim 1, wherein the inner shell has a round outlet end.

8. The nozzle tip of claim 1, wherein the inner shell is lined with at least one of: an abrasion resistant metallic material and a ceramic material.

9. A pulverized solid fuel nozzle assembly comprising:

a. a fuel feed pipe including:

a generally cylindrical shell having a round outlet end, a bulbous protrusion disposed around a perimeter of the outlet end of the generally cylindrical shell, and at least two feed pipe apertures proximate the round outlet end of the fuel feed pipe wherein at least a portion of one of the apertures is generally diametrically opposite the other feed pipe aperture;

b. a nozzle tip pivotally secured relative to the fuel feed pipe, the nozzle tip including:

an inner shell having a generally round cross section throughout its length, the inner shell having a round inlet end arranged in concentric relationship with the round outlet end of the generally cylindrical shell of the fuel feed pipe, the round inlet end being disposed around the bulbous protrusion for forming a seal between the inner shell and the fuel feed pipe, the inner shell having at least two shell apertures between the round inlet end and the round outlet end, wherein at least a portion of one of the shell apertures is generally diametrically opposite from the other shell aperture;

an outer shell arranged in coaxial relationship with the inner shell, and an annular air channel disposed between the inner and outer shells;

c. a first pin passing through a shell aperture and a feed pipe aperture; and d. a second pin passing through the other shell aperture and the other feed pipe aperture;

wherein the nozzle tip is pivotable about at least two axes to allow for tilting around the first and second pins and at least one aperture is elongated allowing one of the pins to slide within it allowing yawing of the nozzle tip and for directing a stream of pulverized solid fuel from the inner shell to a desired location.

10. The nozzle assembly of claim 9, further comprising:

a means for adjusting flame shape disposed within the fuel feed pipe.

11. The nozzle assembly of claim 10, wherein the means for adjusting includes:

a support member disposed within the generally cylindrical shell; and at least one of a swirler and a bluff body disposed at an end of the support member that is positionable with respect to the nozzle tip to adjust the flame shape.

12. The nozzle assembly of claim 9, wherein the outer shell has an inlet end having a multi-sided cross sectional shape and an outlet end having a round cross sectional shape.

13. The nozzle assembly of claim 12, wherein the inlet end of the outer shell includes a bulbous portion disposed on at least two sides of the multi-sided cross sectional shape.

14. The nozzle assembly of claim 9, wherein the inner shell has a convergent or divergent throat.

15. The nozzle assembly of claim 9, wherein the inner shell has a constant diameter throat.

16. The nozzle assembly of claim 9, wherein the generally cylindrical shell has a convergent or divergent throat.

17. The nozzle assembly of claim 9, wherein the generally cylindrical shell has a constant diameter throat.

18. The nozzle assembly of claim 9, wherein at least one of the generally cylindrical shell and the inner shell are lined with at least one of: an abrasion resistant metallic material and a ceramic material.

19. A pulverized solid fuel nozzle assembly comprising:

a fuel feed pipe including:

a. a generally cylindrical shell having:

a round outlet end, and a bulbous protrusion disposed around a perimeter of the outlet end of the generally cylindrical shell;

at least two feed pipe apertures proximate the round outlet end of the fuel feed pipe wherein at least a portion of one of the apertures is generally diametrically opposite the other feed pipe aperture;

b. a nozzle tip pivotally secured relative to the fuel feed pipe, the nozzle tip including:

an inner shell having a generally round cross section throughout its length, the inner shell having a round inlet end arranged in concentric relationship with the round outlet end of the generally cylindrical shell of the fuel feed pipe, the round inlet end being disposed around the bulbous protrusion for forming a seal between the inner shell and the fuel feed pipe, the inner shell having at least two shell apertures between the round inlet end and the round outlet end, wherein at least a portion of one of the shell apertures is generally diametrically opposite from the other shell aperture;

an outer shell arranged in coaxial relationship with the inner shell, and an annular air channel disposed between the inner and outer shells; and c. a first pin passing through a shell aperture and a feed pipe aperture; and d. a second passing through the other shell aperture and the other feed pipe aperture;

e. a device for adjusting flame shape disposed within the fuel feed pipe, the device including:

a support member disposed within the generally cylindrical shell; and at least one of a swirler and a bluff body disposed at an end of the support member that is positionable with respect to the nozzle tip to adjust the flame shape;

wherein the nozzle tip is pivotable about at least two axes to allow for tilting around the first and second pins and at least one aperture is elongated allowing one of the pins to slide and pivot within it allowing yawing of the nozzle tip and for directing a stream of pulverized solid fuel from the inner shell to a desired location.

20. The nozzle assembly of claim 19, wherein the outer shell has an inlet end having a multi-sided cross sectional shape and an outlet end having a round cross sectional shape.

21. The nozzle assembly of claim 19, wherein the inner shell has a convergent or divergent throat.

22. The nozzle assembly of claim 19, wherein the inner shell has a constant diameter throat.

23. The nozzle assembly of claim 19, wherein the generally cylindrical shell has a convergent or divergent throat.

24. The nozzle assembly of claim 19, wherein the generally cylindrical shell has a constant diameter throat.

25. The nozzle assembly of claim 19, further comprising:

at least one pin extending from the fuel feed pipe to the inner shell of the tip section, the at least one pin being axially aligned with an axis about which the nozzle tip pivots.

26. The nozzle assembly of claim 19, wherein at least one of the generally cylindrical shell and the inner shell are lined with at least one of: an abrasion resistant metallic material and a ceramic material.

* * * * *